US008897098B2

(12) United States Patent
Kajitani et al.

(10) Patent No.: US 8,897,098 B2
(45) Date of Patent: Nov. 25, 2014

(54) TIME INFORMATION OBTAINING DEVICE AND RADIO-CONTROLLED TIMEPIECE

(71) Applicant: Casio Computer Co., Ltd., Tokyo (JP)

(72) Inventors: Haruo Kajitani, Akiruno (JP); Takashi Sano, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 14/069,082

(22) Filed: Oct. 31, 2013

(65) Prior Publication Data

US 2014/0160898 A1 Jun. 12, 2014

(30) Foreign Application Priority Data

Dec. 6, 2012 (JP) ..... 2012-266904

(51) Int. Cl.
*G04R 20/00* (2013.01)

(52) U.S. Cl.
CPC ..... *G04R 20/00* (2013.01)
USPC ..... 368/47

(58) Field of Classification Search
USPC ..... 368/10, 46, 47; 375/227; 455/226.2, 455/226.3
See application file for complete search history.

(56) References Cited

U.S. PATENT DOCUMENTS

| | | | | |
|---|---|---|---|---|
| 6,044,106 | A * | 3/2000 | Suzuki | 375/219 |
| 7,720,452 | B2 * | 5/2010 | Miyahara et al. | 455/191.1 |
| 8,243,554 | B2 * | 8/2012 | Kajitani | 368/47 |
| 2006/0187757 | A1 * | 8/2006 | Ihashi | 368/47 |
| 2007/0115759 | A1 * | 5/2007 | Sano | 368/47 |

FOREIGN PATENT DOCUMENTS

JP 2012-189558 A 10/2012

* cited by examiner

*Primary Examiner* — Vit W Miska
(74) *Attorney, Agent, or Firm* — Holtz, Holtz, Goodman & Chick PC

(57) ABSTRACT

A time information obtaining device and a radio-controlled timepiece are shown. According to one implementation, the time information obtaining device includes a noise determining section and a reception cancelling section. The noise determining section determines whether noise mixed in a demodulated signal of a radio wave received within a predetermined unit of time is equal to or more than a predetermined threshold level. The reception cancelling section cancels reception of the radio wave when a number of times that the noise determining section determines that the noise mixed in the signal is equal to or more than a predetermined level is included at a percentage equal to or more than a predetermined percentage within a set time including a plurality of the units of time.

20 Claims, 6 Drawing Sheets

FIG. 2

| SECOND | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 |
|---|---|---|---|---|---|---|---|---|---|---|---|---|---|---|---|---|---|---|---|---|---|---|---|---|---|---|---|---|---|---|
| JJY | P | 40m | 20m | 10m | 0 | 8m | 4m | 2m | 1m | P1 | 0 | 0 | 20h | 10h | 0 | 8h | 4h | 2h | 1h | P2 | 0 | 0 | 200d | 100d | 0 | 80d | 40d | 20d | 10d | P3 |
| | MARKER | 10 MINUTE UNIT DIGIT | | | EXTENDED | 1 MINUTE UNIT DIGIT | | | | MARKER | EXTENDED | | 10 HOUR UNIT DIGIT | | EXTENDED | 1 HOUR UNIT DIGIT | | | | MARKER | EXTENDED | | 100 DAY UNIT DIGIT | | EXTENDED | 10 DAY UNIT DIGIT | | | | MARKER |

| SECOND | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 |
|---|---|---|---|---|---|---|---|---|---|---|---|---|---|---|---|---|---|---|---|---|---|---|---|---|---|---|---|---|---|---|
| JJY | 8d | 4d | 2d | 1d | 0 | 0 | PA1 | PA2 | SU1 | P4 | SU2 | 80y | 40y | 20y | 10y | 8y | 4y | 2y | 1y | P5 | 4w | 2w | 1w | LS1 | LS2 | 0 | 0 | 0 | 0 | P0 |
| | 1 DAY UNIT DIGIT | | | | EXTENDED | | HOUR PARITY | MINUTE PARITY | | MARKER | | 10 YEAR UNIT DIGIT | | | | 1 YEAR UNIT DIGIT | | | | MARKER | DAY OF WEEK | | | LEAP SECOND | | EXTENDED | | | | MARKER |

TIME INFORMATION OBTAINING DEVICE AND RADIO-CONTROLLED TIMEPIECE

BACKGROUND OF THE INVENTION

1. Field of the Invention

The present invention relates to a time information obtaining device and a radio-controlled timepiece.

2. Description of the Related Art

Conventionally, there is an electronic timepiece which receives a radio wave including time information, and automatically calibrates the time so as to be able to maintain display of the accurate time. As a radio wave which includes the time information, there is an airwave called a standard radio wave which transmits encoded time information with a radio wave in a long wavelength band. Various electronic timepieces (radio-controlled timepieces) which receive such standard radio wave to obtain time information are being developed.

The radio wave in the long wavelength band is transmitted long distances throughout the surface of the Earth. Therefore, it is possible to receive and use the standard radio wave at a point far from a transmission station. However, noise which is generated in the same wavelength band is also similarly transmitted long distances. Moreover, the radio wave attenuates inside a building made of a steel frame or reinforced concrete. Therefore, various techniques to enhance receiving sensitivity and to cope with noise are being developed in radio-controlled timepieces.

Specifically, in an electronic timepiece where the power capacity is small due to weight and size as in a watch, since the power consumed when the radio wave is received is very large, a technique is developed to promptly cancel or interrupt reception when the state of reception is bad and it is unlikely that the time information can be obtained. For example, Japanese Patent Application Laid-Open Publication No. 2012-189558 discloses a technique to judge the radio wave reception intensity based on AGC (automatic gain control) voltage or a technique to judge noise intensity based on degree of accuracy of deciding the position of change of the signal (amplitude) intensity.

However, if the noise is mixed at an important timing for determining the code when the standard radio wave is received, it becomes difficult to determine the code. When the noise mixed in the standard radio wave is a sudden noise (burst noise) instead of continuous noise, conventional methods cannot accurately judge the influence of the noise to judge whether to continue or cancel reception of the radio wave.

The present invention is a time information obtaining device and a radio-controlled timepiece which can more accurately judge whether or not to obtain time information and which can cancel the reception of the radio wave during the reception.

SUMMARY OF THE INVENTION

According to an aspect of the present invention, there is provided a time information obtaining device which receives a radio wave including time information to obtain time information, the time information obtaining device including:

a noise determining section which determines whether noise mixed in a demodulated signal of a radio wave received within a predetermined unit of time is equal to or more than a predetermined threshold level; and a reception cancelling section which cancels reception of the radio wave when a number of times that the noise determining section determines that the noise mixed in the signal is equal to or more than a predetermined level is included at a percentage equal to or more than a predetermined percentage within a set time including a plurality of the units of time.

BRIEF DESCRIPTION OF THE DRAWINGS

The present invention and the above-described objects, features and advantages thereof will become more fully understood from the following detailed description with the accompanying drawings and wherein;

FIG. 2 is a diagram describing a code array of JJY;

DETAILED DESCRIPTION OF THE PREFERRED EMBODIMENTS

Below, an embodiment of the present invention is described with reference to the drawings.

Figure 1:
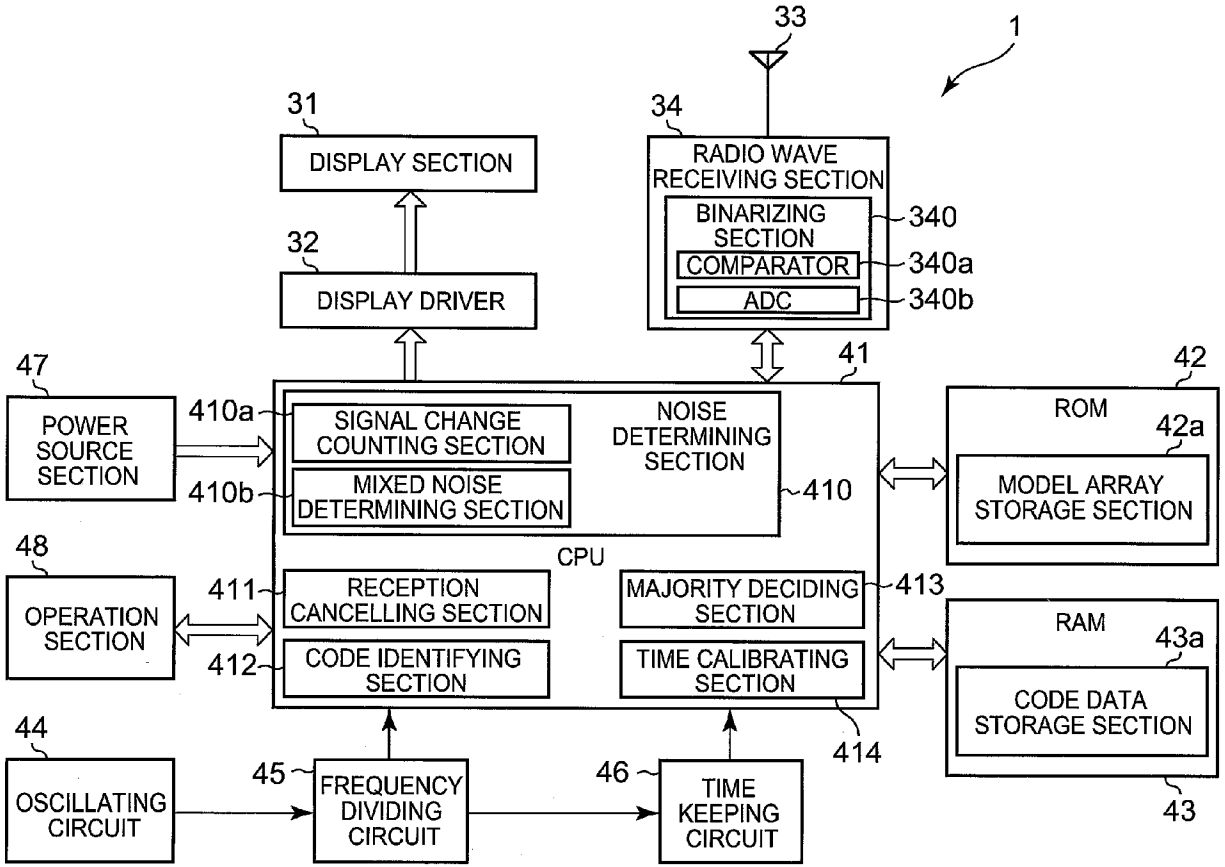
FIG. 1 is a block diagram showing an internal configuration of an electronic timepiece of an embodiment of the present invention.

FIG. 1 is a block diagram showing an internal configuration of an electronic timepiece 1 of an embodiment of the present invention.

The electronic timepiece 1 is a radio-controlled timepiece which can receive a standard radio wave to calibrate the time. The electronic timepiece 1 can be a portable watch or a pocket watch, or a table clock or a wall clock.

The electronic timepiece 1 includes a display section 31 (time display section), a display driver 32 which drives the display section 31, an antenna 33, a radio wave receiving section 34 (receiving section) which receives a radio wave through the antenna 33, a CPU (Central Processing Unit) 41 (a noise determining section 410, a reception cancelling section 411, a signal change counting section 410*a*, a mixed noise determining section 410*b*, a code identifying section 412, a majority deciding section 413, a time calibrating section 414), a ROM (Read Only Memory) 42, a RAM (Random Access Memory) 43, an oscillating circuit 44, a frequency dividing circuit 45, a time keeping circuit 46 (time keeping section), a power source section 47, an operation section 48, and the like.

For example, the display section 31 is a digital display section including a liquid crystal display section of a dot matrix type, and the display driver 32 is a liquid crystal display driver. The display section 31 can use a liquid crystal display of a segmented method or can use other digital display types such as an organic EL (electro-luminescent) display. The display driver 32 is a display driver which is driven in a method corresponding to the type of display used in the display section 31.

Alternatively, the electronic timepiece 1 can be an analog display type electronic timepiece including a rotating display section such as a plurality of needles as the display section 31. The rotating display section can be rotated through an array of gears driven by a step motor.

The antenna 33 and the radio wave receiving section 34 receive a radio wave with a long wavelength band, amplify and detect an amplitude modulated wave and demodulates a signal from the standard radio wave including time information. The radio wave receiving section 34 is configured to be able to synchronize with the reception frequency selected from among the frequencies of the plurality of standard radio waves set in advance. The radio wave receiving section 34 may include a binarizing section 340 including a comparator 340*a* and an analog/digital convertor (ADC) 340*b*. The binarizing section 340 binarizes the obtained signal to a high-level signal or a low-level signal according to a predetermined threshold level (binarizing threshold level) to output the signal to the CPU 41 at a predetermined sampling frequency (for example, 64 Hz). The data can be binarized at an active low so that the signal is to be a low level in a term when the amplitude is large and the signal is to be a high level in a term when the amplitude is small. By setting the intensity of the amplified and demodulated signal to be as even as possible using the AGC, it is possible to standardize the input signal level with respect to the threshold level for determining the boundary between the high-level signal and the low-level signal.

The CPU 41 performs various calculating processing and centrally controls the entire operation of the electronic timepiece 1. When the electronic timepiece 1 is started, the CPU 41 reads a control program from the ROM 42 and executes the program. With this, the CPU 41 performs processing regarding continuously counting the time and displaying the time. Moreover, the CPU 41 operates the radio wave receiving section 34 at a regular interval such as once a day to receive the standard radio wave, and calibrates the time. The time information obtaining device is composed of the above described antenna 33, the radio wave receiving section 34, and the CPU 41.

Various programs and setting data are stored in the ROM 42. Included in the various programs is a decrypting program to decode and obtain accurate time information from the demodulated standard radio wave signal. The ROM 42 includes a model array storage section 42*a* which stores 10 model arrays (in other words, the first one minute unit digit is any one of 0 to 9) to calculate a degree of match with the code array of 12 codes arranging in order 3 groups of 4 codes showing the one minute unit digit which can be obtained from the code array of 3 consecutive minutes (3 frames).

The RAM 43 provides a work memory space in the CPU 41 and stores temporary data. The RAM 43 includes a code data storage section 43*a* which can store code data for a plurality of identified frames.

The oscillating circuit 44 is a circuit which generates and outputs a frequency signal, and for example, a crystal oscillator is used. The frequency dividing circuit 45 divides and outputs a signal input from the oscillating circuit 44 to a signal with a frequency used in each section such as the CPU 41 and the time keeping circuit 46. The time keeping circuit 46 counts the number of times a predetermined frequency signal is input from the frequency dividing circuit 45 and adds the number to a preset initial time to count the present time.

The power source section 47 supplies predetermined electric power necessary for the operation of the CPU 41 and the display driver 32. For example, the power source section 47 includes a solar battery or a secondary battery and is able to supply electric power continuously for a long period of time.

The operation section 48 includes a pressing button or a winding crown to accept operation from outside. The accepted operation is converted to an electric signal, and the electric signal is output to the CPU 41. The operation section 48 may include a detecting sensor for a touch panel, and the display screen of the display section 31 may be used as a touch panel.

Next, the codes included in the standard radio wave and the identification of the codes are described.

In the example described below, the time information is obtained from the standard radio wave signal of JJY which is the standard radio wave transmission station of Japan. However, time information can also be similarly obtained from other standard radio wave signals by selecting and using a suitable encoding format.

According to JJY, the time information is represented by three types of codes (time code) showing "0", "1", and "P" in an array according to a predetermined format, and the code array signal regarding the time information is modulated and transmitted. The three types of codes are distinguished according to the length of the term with a large amplitude which is started synchronized with the start of the timing of each second (second synchronizing point). In other words, the code "0" is shown when a term with a predetermined amplitude (high level term) continues for 0.8 seconds and then a term with an amplitude of 10% of the above amplitude (low level term) continues for 0.2 seconds. The code "1" is shown when a term with a predetermined amplitude continues for 0.5 seconds and then a term with an amplitude of 10% of the above amplitude continues for 0.5 seconds. The code "P" is shown when a term with a predetermined amplitude continues for 0.2 seconds and then a term with an amplitude of 10% of the above amplitude continues for 0.8 seconds.

Each of the above codes can be identified by detecting the timing that the amplitude changes from the large state to the small state in each second of the demodulated signal (timing of a falling edge of a signal intensity). As described above, such timing of the falling edge is any one of 0.2 seconds, 0.5 seconds, or 0.8 seconds. Therefore, it is possible to read which code the code is by directly or indirectly identifying which one of the above the code is. Various known methods can be used as the specific methods including techniques to enhance the accuracy of identification. A code string for 1 frame in which 60 identified codes showing 60 seconds are arranged is decoded according to a predetermined format to obtain the time information.

FIG. 2 is a diagram describing a code array of data of 1 frame of JJY.

In the standard radio wave of JJY, the code "P" is transmitted fixed as a position marker showing a timing when the value of the one second unit digit is "9" and as a marker showing a timing of the start of each minute (00 seconds). The codes "0" and "1" transmitted in other timing show the content of the time information. Binary Coded Decimal is used for the display of the value of the time and date. The values showing ten minute unit digit, one minute unit digit, ten hour unit digit, one hour unit digit, hundred day unit digit, ten day unit digit, one day unit digit, ten year unit digit and one year unit digit are each shown binary of 2 to 4 bits. For example, the value of the ten minute unit digit in the time of a certain minute is shown by the array of code data of 3 codes transmitted in 1 to 3 seconds of each minute (3 bit data), and the value of the one minute unit digit in the time of a certain minute is shown by an array of code data of four codes transmitted in 5 to 8 seconds of each minute (4 bit data).

As other contents of time information, there are day of week, parity data for checking data, information showing when a leap second is inserted, and extended blocks for future use such as summer time information. Among the above, other than the code array showing day of the week (3 bit data), the data is not always necessary for the display of the time and the data. Therefore, after the position of the start of each minute is identified, as for the above codes and the code "P"

which is a total of 26 codes (24 codes when a parity check is performed), it may not be a problem even if the codes cannot be identified due to noise, etc.

Here, as described above, normally, the falling edge of the signal intensity appears once for each second showing one code. However, when the C/N ratio is bad due to low reception level, the rising edge timing and the falling edge timing of the signal intensity are not determined accurately, and the rising edge and the falling edge are detected a plurality of times in each second. Even if the reception level is high, when noise is mixed temporarily, the signal intensity temporarily rises during the noise, and the rising edge and the falling edge of the signal may be detected a plurality of times. If the number of the falling edges and the rising edges of the signal intensity increases, it is not possible to identify the code accurately. However, if the rising edge and the falling edge are not detected, this means the signal intensity is too low to identify the code or the noise is continuously strong. Therefore, it is possible to judge the amount of influence from the noise by counting the number of the falling edges (or the number of the rising edges) in the signal for each second.

Next, the operation to obtain the time information performed in the electronic timepiece 1 of the embodiment of the present invention is described.

In the electronic timepiece 1 of the present embodiment, a signal of a predetermined amount of time set in advance (set time) such as 20 seconds is synchronized to each second (unit of time) to be divided into 20 pieces for each second. The number of falling edges in the signal detected within the term is counted. Then, when it is judged that the counted number is 0 or equal to or more than a predetermined threshold (equal, to or more than a threshold level), the second is counted as the noise term. When the number of noise terms within the 20 seconds is equal to or more than the predetermined number, it is judged that it is difficult to obtain accurate time information and the reception of the standard radio wave is canceled during reception.

Figure 3:
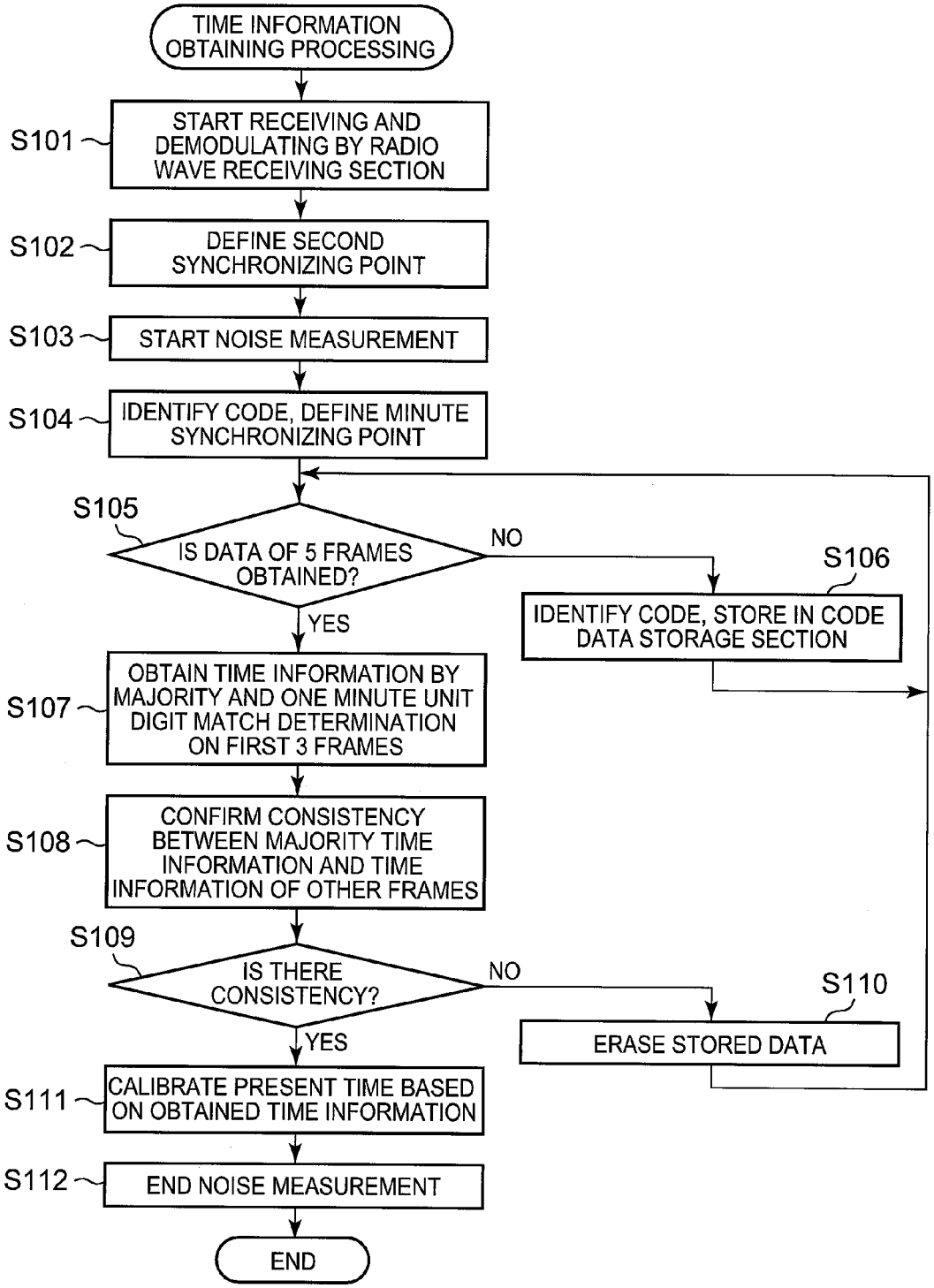
FIG. 3 is a flowchart showing a control procedure of time information obtaining processing in an electronic timepiece of a first embodiment.

FIG. 3 is a flowchart showing a control procedure of the time information obtaining processing performed by the CPU 41.

For example, the time information obtaining processing is processing which is called and automatically started at a preset time every day or processing which is started manually based on input operation to the operation section 48 by the user.

When the time information obtaining processing is started, the CPU 41 operates the radio wave receiving section 34 to start reception of the standard radio wave and demodulation of the signal (step S101). Next, the CPU 41 obtains the demodulated signal from the radio wave receiving section 34, and detects and defines the second synchronizing point from the wave pattern (step S102). As the method of defining the second synchronizing point, it is possible to use various well known methods. For example, in the time information obtaining processing, the CPU 41 adds digital data sampled at a temporal resolution (for example, 32 Hz) high enough for the length (1 second) of each code for each piece of data at a same phase in a cycle of 1 second. As a result, the CPU 41 is able to identify the point in which the change of the intensity of amplitude of the signal from the low level to the high level is most drastic as the second synchronizing point. The sampled digital data can be binary data or multi-valued data.

When the second synchronizing point is identified, the CPU 41 starts the processing regarding the later described noise measurement (step S103). The processing regarding the noise measurement is processing performed parallel with the time information obtaining processing by the CPU 41. Then, the CPU 41 sequentially identifies the code from the signal of each second. The CPU 41 detects the point where the code "P" continues two times and defines the timing of the start of 0 second of each minute (minute synchronizing point) (step S104). For example, in the time information obtaining processing, the CPU 41 obtains the average amplitude intensity of each term by adding and averaging data of 0.2 seconds to 0.5 seconds from the second synchronizing point and data of 0.5 seconds to 0.8 seconds from the second synchronizing point among the data sampled at the above high temporal resolution. Then, the CPU 41 identifies the code based on whether the average amplitude intensity is closer to the low level or the high level.

When the minute synchronizing point is detected, the CPU 41 judges whether a predetermined number of frames (here, 5 frames) of the code string data is obtained (step S105). When it is judged that a predetermined number of frames of code string data is not yet obtained (step S105, "NO"), the CPU 41 obtains the signal of the next second, identifies the code, and stores the identified code corresponded with the value of the second in the code data storage section 43*a* (step S106). Then, the processing of the CPU 41 returns to step S105.

When it is judged that a predetermined number of frames of code string data is obtained (step S105, "YES"), the CPU 41 decides the majority among the 3 codes identified in each second excluding the data portion showing the one minute unit digit (5 seconds to 8 seconds) and the data portion showing the minute unit parity (37 seconds) for the code string data of the first 3 frames from the code string data of the obtained 5 frames. Then, the CPU 41 selects the code of the majority and obtains the time information based on the code string data generated as a result of the above (step S107). The CPU 41 calculates the degree of match between the code string of 12 codes consisting of the 4 codes showing the one minute unit digit identified in 3 frames arranged in the order of reception and the code string of 10 patterns stored in the model array storage section 42*a*. Based on the 3 values of the one minute unit digit shown by the matching or most similar code string, the CPU 41 sets the value of the one minute unit digit of the obtained time information.

The processing of step S107 can be performed for the code each time the code of the third frame is identified, or the code string each time the code string of each digit in the time information of the third frame is obtained. Alternatively, the processing of step S107 can be performed parallel with the processing of receiving the signal and identifying the code of the remaining 2 frames.

The CPU 41 obtains the time information from the code array of the remaining 2 frames, and the CPU 41 confirms the consistency between the obtained two pieces of time information and majority time information obtained in the processing of step S107 (step S108). The CPU 41 judges whether the result of the confirmation shows that there is consistency (step S109). When it is judged that there is no consistency (step S109, "NO"), the CPU 41 advances the processing to step S110. The CPU 41 erases the obtained data with no consistency and then returns the processing to step S105 to obtain the data again.

Here, the CPU 41 can erase the code string data of all 5 frames or if the code string data of only 1 frame is not consistent, the CPU 41 can erase only the code string data of the frame which is not consistent. Alternatively, the CPU 41 can erase the code string data of the oldest frame.

When it is judged that there is consistency (step S109, "YES"), the CPU 41 sets the present time based on the time information with consistency, and the present time of the time keeping circuit 46 is overwritten and calibrated (step S111).

Then, the CPU 41 ends the noise measuring processing (step S112) and ends the time information obtaining processing.

Figure 4:
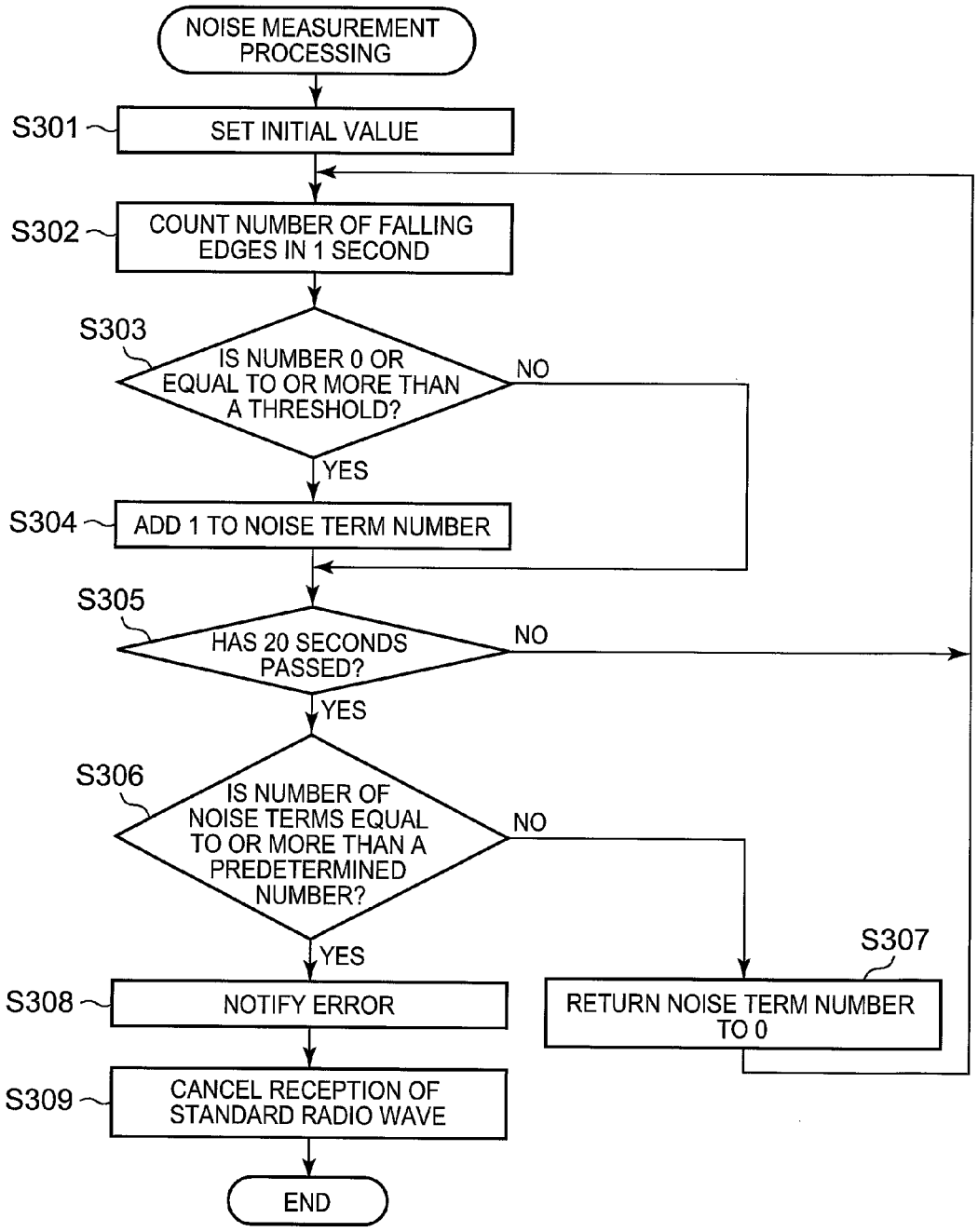
FIG. 4 is a flowchart showing a processing procedure of noise measuring processing.

FIG. 4 is a flowchart showing the processing procedure of the noise measuring processing called and performed parallel with the processing of step S103.

When the noise measuring processing starts, the CPU 41 first initializes setting (step S301). In other words, the CPU 41 holds the variable of counting the number of times the falling edge is counted in each second and the number of noise terms in the RAM 43, and sets the number to the initial value "0".

Then, the data obtained in the predetermined sampling frequency from the radio wave receiving section 34 in the one second started by synchronizing with the synchronizing point of each second is analyzed. The CPU 41 adds 1 to the number of times of the falling edge each time the CPU 41 detects the change from the value showing that the signal intensity is strong (for example, "0" in the binary data of the active low) to the value showing that the signal intensity is weak (for example, "1" in the binary data of the active low) (step S302).

When one second passes, the CPU 41 judges whether the number of counted falling edges in one second is "0" or equal to or more than the threshold (step S303). When it is judged that the number is "0" or equal to or more than the threshold (step S303, "YES"), the CPU 41 adds 1 to the number of counted noise terms (step S304), and advances the processing to step S305. When it is judged that the number is neither "0" nor equal to or more than the threshold (step S303, "NO"), the processing of the CPU 41 advances directly to step S305.

When the processing advances to step S305, the CPU 41 judges whether 20 seconds have passed and the number of noise terms for 20 seconds is obtained. When it is judged that 20 seconds have not passed (step S305, "NO"), the processing of the CPU 41 returns to step S302 and the processing of steps S302 to S305 is repeated.

When it is judged that 20 seconds have passed (step S305, "YES"), next, the CPU 41 judges whether the obtained number of noise terms within 20 seconds is equal to or more than the predetermined number (step S306). When it is judged that the number is not equal to or more than the predetermined number (step S306, "NO"), the CPU 41 returns the counted number of noise terms to 0 (step S307) and returns the processing to step S302. Then, the CPU 41 repeats the processing of steps S302 to S306, and detects and counts the noise terms from 0 seconds. In other words, the CPU 41 detects and counts the noise terms in a cycle of 20 seconds (predetermined amount of time).

When it is judged that the number is equal to or more than a predetermined number (step S306 "YES"), the CPU 41 displays that there is an error in reception on the display section 31 and stores the above in the RAM 43 (step S308). The CPU 41 cancels the reception of the standard radio wave (step S309), and cancels the time information obtaining processing. Then, the CPU 41 ends the noise measuring processing.

Here, as in the time information obtaining processing of the present embodiment, when decision by majority is used for each code, it is possible to obtain accurate information even if false determination is mixed once in three times for each code due to noise. Therefore, in the time information obtaining processing, a value of about ⅓ of 20 seconds, in other words, a value equal to or more than 6 or 7 is set as the above described predetermined number. In practice, the noise may be mixed in the code not necessary for obtaining the time information or the timing when the noise is mixed may not influence the identification of the code. Therefore, it is possible to set the predetermined number to a larger number such as about 10.

As described above, the electronic timepiece 1 of the first embodiment includes a radio wave receiving section 34 and an antenna 33 which receive a standard radio wave. The CPU 41 obtains the signal demodulated by the radio wave receiving section 34, and counts the number of changes of the signal by the noise for each second of the signal. When the number of changes counted is equal to or more than a threshold or is 0, it is determined to be a noise mixed term, and when the number of times determined to be a noise mixed term within 20 seconds is equal to or more than a predetermined number, it is judged that obtaining time information is difficult at this point, and the reception of the standard radio wave is canceled. With such determination, it is possible to accurately judge whether it is difficult to obtain time information when the C/N ratio is continuously bad due to the reception radio wave intensity being low or the noise constantly overlapping. It is also possible to make an accurate judgment when it is difficult to identify the code even when the noise is not large considering an average of how frequent the noise is mixed discretely by burst noise mixed irregularly. As a result of the judgment, it is possible to efficiently prevent unnecessary consumption of energy by cancelling the reception of the radio wave during reception when it is difficult to obtain the time information.

The amount of noise mixed can be determined by simply detecting the change of the signal level based on the predetermined threshold level and counting the number of changes. Therefore, it is possible to easily judge how much the mixed noise influences the process of obtaining the time information without performing complicated processing.

The amount of mixed noise is determined by counting the change among binary values after the demodulated signal is binarized using the comparator 340*a* and the ADC 340*b*. Therefore, it is possible to judge the amount of noise mixed by easy processing.

Whether the noise is mixed is judged for each second which is equal to the length of each code in the standard radio wave. Therefore, it is possible to easily and objectively determine the amount of signals which may be difficult to decrypt among the entire signals. Consequently, it is possible to judge whether to continue reception of the radio wave.

The judgment of how much the noise is mixed is continued repeatedly. Therefore, it is possible to accurately judge the amount of mixed noise generated suddenly and/or irregularly. Consequently, it is possible to reduce needless consumption of electric power.

By judging the degree of the mixed noise for each code, when the correct code is decided by majority among a plurality of frames (for example, 3 frames), it is possible to accurately judge whether the amount of mixed noise is a level which does not influence the result of the majority. Therefore, it is possible to decide whether to continue to obtain the time information from the standard radio wave or to abandon obtaining the time information at an early stage. Consequently, it is possible to reduce needless consumption of energy.

By including a configuration which can determine the amount of mixed noise in the electronic timepiece 1, it is possible to reduce consumption of the battery of the electronic timepiece 1. Specifically, the above configuration enhances efficiency of reducing power consumption while maintaining accuracy of time in an electronic timepiece 1 such as a watch where there is a limit in the battery capacity.

[Second Embodiment]

Next, the electronic timepiece 1*a* of the second embodiment is described.

Figure 5:
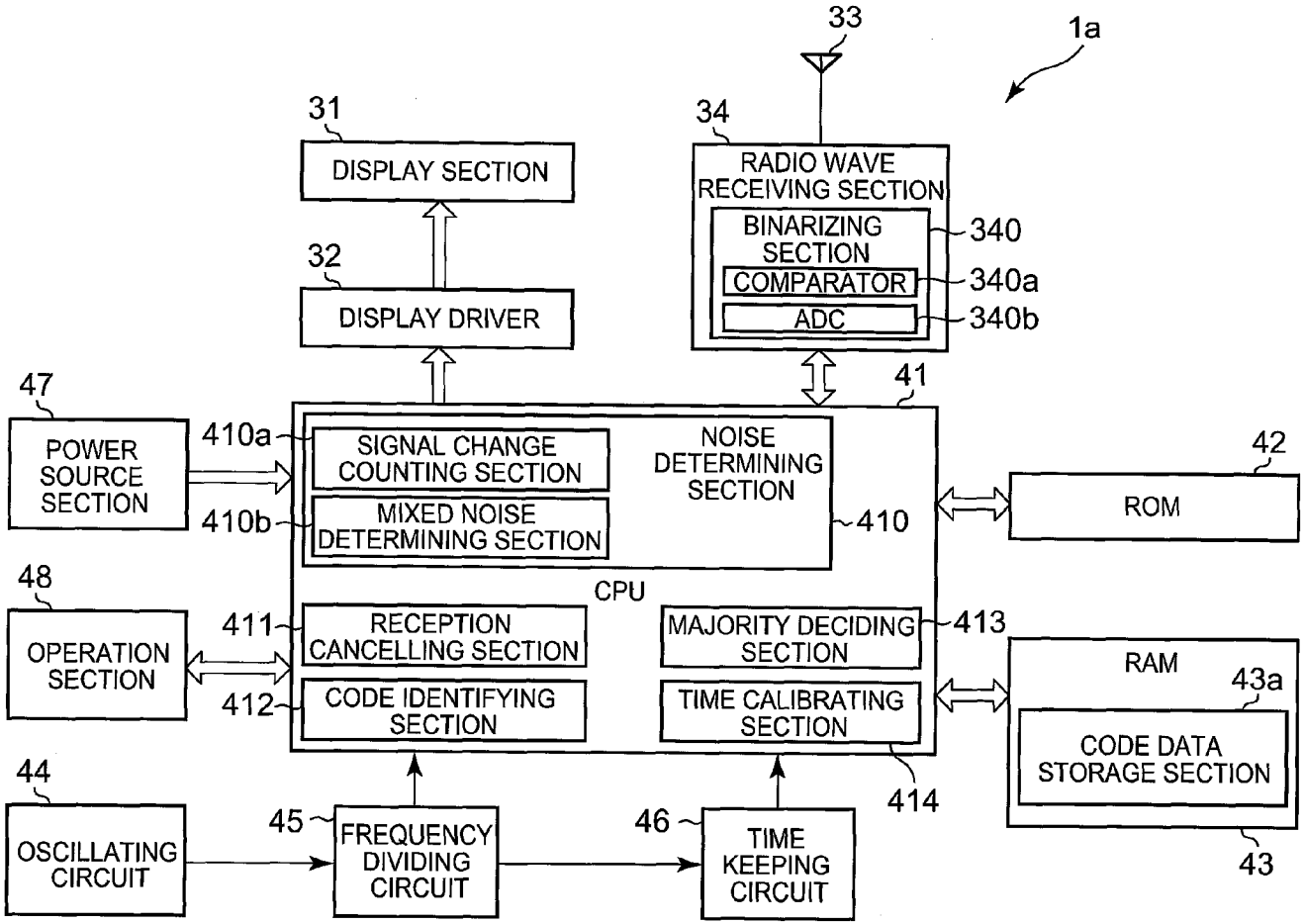
FIG. 5 is a block diagram showing an internal configuration of an electronic timepiece of a second embodiment.

FIG. 5 is a block diagram showing an internal configuration of the electronic timepiece 1*a* of the second embodiment.

The configuration of the electronic timepiece 1*a* of the second embodiment is the same as that of the electronic timepiece 1 of the first embodiment with the exception of the model array storage section 42*a* not being included in the ROM 42. The same reference numerals are applied to the same components, and the description is omitted.

Figure 6:
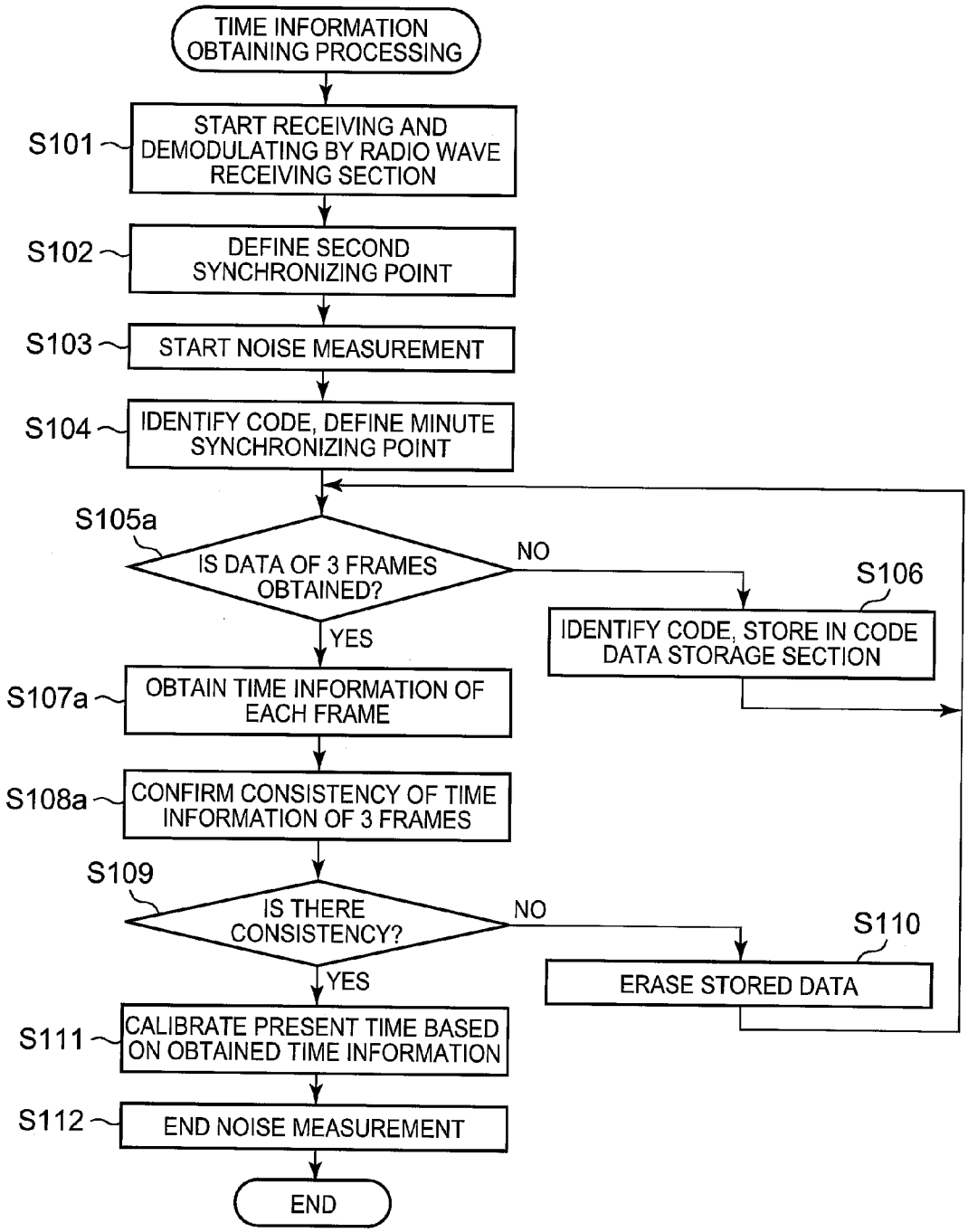
FIG. 6 is a flowchart showing a control procedure of time information obtaining processing of an electronic time piece of a second embodiment.

FIG. 6 is a flowchart showing the control procedure of the time information obtaining processing in the electronic timepiece 1*a* of the second embodiment.

The time information obtaining processing performed by the CPU 41 in the electronic timepiece 1*a* is the same as the time information obtaining processing performed by the CPU 41 in the electronic timepiece 1 of the first embodiment with the exception of the processing of steps S105, S107, and S108 being replaced with steps S105*a*, S107*a*, and S108*a*. The same reference numerals are applied to the same processing, and the description is omitted.

According to the time information obtaining processing of the present embodiment, after the minute synchronizing point is defined (step S104), the CPU 41 obtains the data and identifies the signals until the CPU 41 judges that the data for 3 frames is obtained (step S105*a*). Then, when it is judged that the data for 3 frames is obtained (step S105*a*, "YES"), the CPU 41 decodes and decrypts the code array of each frame to separately obtain the time information (step S107*a*). The CPU 41 confirms the consistency of the obtained time information for the 3 frames (step S108*a*), and judges whether the consistency of the time information is satisfied (step S109).

The noise measuring processing called and performed in the time information obtaining processing is performed with the same processing procedure as the noise measuring processing called in the time information obtaining processing performed in the electronic timepiece 1 of the first embodiment. However, a different value is set as the predetermined number which is the condition for judgment in the processing of step S306. In other words, in the time information obtaining processing of the present embodiment, all of the pieces of the time information of each frame need to be obtained accurately. Therefore, the present embodiment receives influence of the noise more easily than the time information obtaining processing by the electronic timepiece 1 of the first embodiment. However, in the present embodiment also, the noise may be mixed in the code not necessary for obtaining the time information, or the timing when the noise is mixed may not influence the identification of the code. Therefore, it is possible to set the predetermined number to for example, about 3 or 4.

As described above, similar to the electronic timepiece 1 of the first embodiment, according to the electronic timepiece 1*a* of the second embodiment, the CPU 41 obtains the signal demodulated by the radio wave receiving section 34 and counts the number of changes of the signal by the noise for each second of the signal. When the number of changes counted is equal to or more than a threshold or is 0, it is determined to be a noise mixed term, and when the number of times determined to be a noise mixed term within 20 seconds is equal to or more than a predetermined number, it is judged that obtaining time information is difficult at this point, and the reception of the standard radio wave is canceled. Therefore, when there is a request to obtain accurate time information successively from received data of a predetermined number of frames (here, 3 frames), it is possible to judge when it is difficult to obtain accurate time information considering the possibility that the noise may be mixed in portions where it is allowable even if noise is mixed such as the marker code portion or the extended code portion, or the possibility that the timing that the burst noise is mixed may not be crucial for identifying the code. When it is judged to be difficult, it is possible to promptly cancel reception of the radio wave and to reduce unnecessary consumption of electric power.

The present invention is not limited to the above embodiments and various modifications can be made.

For example, the above embodiments describe an example using JJY. Alternatively, it is possible to employ the present invention when receiving the standard radio wave using the amplitude modulation of the long wavelength band in various countries such as WWVB of the United States, MSF of Great Britain, DCF 77 of Germany, and the like.

According to the above embodiments, the rising edge or the falling edge of the binarized signal is counted after the demodulated signal is binarized. However, it is possible to count the change in the signal equal to or more than a predetermined level in multi-valued data or analog data.

According to the above embodiments, after the second synchronizing point is defined, whether to cancel the reception of the radio wave is determined repeatedly every 20 seconds in the noise measuring processing. However, a predetermined interval may be provided between determining the noise. Alternatively, the noise can be determined overlapping a portion (for example, 10 seconds).

According to the above embodiments, the rising edge or the falling edge of the signal of each second is counted dividing at each second synchronizing point. However, synchronizing with the second synchronizing point is not necessary. In this case, the number of the falling edges is not necessarily once in each divided term. Therefore, it is preferable that the judgment is made by the number of rising edges.

According to the above embodiments, the term is divided at 1 second, however, it is not necessary to divide at 1 second, and the present invention can be similarly applied when divided at 0.5 seconds or 2 seconds.

According to the above embodiments, the number of terms in which noise is mixed within 20 seconds is counted. However, the length of time can be suitably adjusted. Statistically, it is possible to determine the noise level more accurately by setting a longer period of time. However, it is possible to more promptly cancel the operation of reception and to reduce the consumption of electric power by setting a shorter period of time.

In addition to the above, the details regarding the specific configuration, control content and procedure shown in the above embodiments can be suitably changed without leaving the scope of the invention.

Although various exemplary embodiments have been shown and described, the invention is not limited to the embodiments shown. Therefore, the scope of the invention is intended to be limited solely by the scope of the claims that follow and its equivalents.

The entire disclosure of Japanese Patent Application No. 2012-266904 filed on Dec. 6, 2012 including specification, claims, drawings and abstract are incorporated herein by reference in its entirety.

What is claimed is:

1. A time information obtaining device which receives a radio wave including time information to obtain time information, the time information obtaining device comprising:

a noise determining section which determines whether noise mixed in a demodulated signal of a radio wave received within a predetermined unit of time is equal to or more than a predetermined threshold level; and a reception cancelling section which cancels reception of the radio wave when a number of times that the noise determining section determines that the noise mixed in the signal is equal to or more than a predetermined level is included at a percentage equal to or more than a predetermined percentage within a set time including a plurality of the units of time.

2. The time information obtaining device according to claim 1, wherein, the noise determining section includes:

a signal change counting section which counts a number of times the demodulated signal of the received radio wave changes to a signal level equal to or more than a predetermined signal level in the unit of time; and a mixed noise determining section which determines whether the mixed noise is equal to or more than the threshold level when the counted number of times the signal level changes is outside a range of a preset number.

3. The time information obtaining device according to claim 2, further comprising, a binarizing section which binarizes the demodulated signal of the received radio wave based on a predetermined binarizing threshold level, wherein, the signal change counting section counts a number of times the binarized demodulated signal changes.

4. The time information obtaining device according to claim 1, wherein, the unit of time is equal to a length of each code in a code string showing the time information.

5. The time information obtaining device according to claim 2, wherein, the unit of time is equal to a length of each code in a code string showing the time information.

6. The time information obtaining device according to claim 3, wherein, the unit of time is equal to a length of each code in a code string showing the time information.

7. The time information obtaining device according to claim 1, wherein, the reception cancelling section repeatedly judges whether to cancel the reception of the radio wave based on a recent determining result of mixed noise in the set time each time a predetermined amount of time passes while the radio wave is received.

8. The time information obtaining device according to claim 2, wherein, the reception cancelling section repeatedly judges whether to cancel the reception of the radio wave based on a recent determining result of mixed noise in the set time each time a predetermined amount of time passes while the radio wave is received.

9. The time information obtaining device according to claim 3, wherein, the reception cancelling section repeatedly judges whether to cancel the reception of the radio wave based on a recent determining result of mixed noise in the set time each time a predetermined amount of time passes while the radio wave is received.

10. The time information obtaining device according to claim 4, wherein, the reception cancelling section repeatedly judges whether to cancel the reception of the radio wave based on a recent determining result of mixed noise in the set time each time a predetermined amount of time passes while the radio wave is received.

11. The time information obtaining device according to claim 1, further comprising:

a code identifying section which identifies each code of a code string showing the time information in the demodulated signal; and a majority deciding section which decides one code by majority for each code which does not change within the predetermined number of times according to the time information, among a predetermined number of codes identified in a same position in code strings obtained a predetermined number of times equal to 3 or more.

12. The time information obtaining device according to claim 2, further comprising:

a code identifying section which identifies each code of a code string showing the time information in the demodulated signal; and a majority deciding section which decides one code by majority for each code which does not change within the predetermined number of times according to the time information, among a predetermined number of codes identified in a same position in code strings obtained a predetermined number of times equal to 3 or more.

13. The time information obtaining device according to claim 3, further comprising:

a code identifying section which identifies each code of a code string showing the time information in the demodulated signal; and a majority deciding section which decides one code by majority for each code which does not change within the predetermined number of times according to the time information, among a predetermined number of codes identified in a same position in code strings obtained a predetermined number of times equal to 3 or more.

14. The time information obtaining device according to claim 4, further comprising:

a code identifying section which identifies each code of a code string showing the time information in the demodulated signal; and a majority deciding section which decides one code by majority for each code which does not change within the predetermined number of times according to the time information, among a predetermined number of codes identified in a same position in code strings obtained a predetermined number of times equal to 3 or more.

15. The time information obtaining device according to claim 7, further comprising:

a code identifying section which identifies each code of a code string showing the time information in the demodulated signal; and a majority deciding section which decides one code by majority for each code which does not change within the predetermined number of times according to the time information, among a predetermined number of codes identified in a same position in code strings obtained a predetermined number of times equal to 3 or more.

16. A radio-controlled timepiece comprising:

a time information obtaining device according to claim 1;

a time keeping section which counts present time;

a time calibrating section which calibrates the present time counted by the time keeping section based on time information obtained by the time information obtaining device; and a time display section which displays the present time counted by the time keeping section in a predetermined format.

17. A radio-controlled timepiece comprising:

a time information obtaining device according to claim 2;

a time keeping section which counts present time;

a time calibrating section which calibrates the present time counted by the time keeping section based on time information obtained by the time information obtaining device; and a time display section which displays the present time counted by the time keeping section in a predetermined format.

18. A radio-controlled timepiece comprising:

a time information obtaining device according to claim 3;

a time keeping section which counts present time;

a time calibrating section which calibrates the present time counted by the time keeping section based on time information obtained by the time information obtaining device; and a time display section which displays the present time counted by the time keeping section in a predetermined format.

19. A radio-controlled timepiece comprising:

a time information obtaining device according to claim 4;

a time keeping section which counts present time;

a time calibrating section which calibrates the present time counted by the time keeping section based on time information obtained by the time information obtaining device; and a time display section which displays the present time counted by the time keeping section in a predetermined format.

20. A radio-controlled timepiece comprising:

a time information obtaining device according to claim 7;

a time keeping section which counts present time;

a time calibrating section which calibrates the present time counted by the time keeping section based on time information obtained by the time information obtaining device; and a time display section which displays the present time counted by the time keeping section in a predetermined format.

* * * * *